US008514139B2

(12) United States Patent
Adams et al.

(10) Patent No.: US 8,514,139 B2
(45) Date of Patent: Aug. 20, 2013

(54) ANTENNA STRUCTURES AND ARRAYS

(75) Inventors: David Adams, Chelmsford (GB); Andrew Urquhart, Bishops Stortford (GB); William Waddoup, Harlow (GB); Dean Kitchener, Brentwood (GB); Steven Hall, Harlow (GB); Simon Gale, Bishops Stortford (GB)

(73) Assignee: Apple, Inc., Cupertino, CA (US)

( * ) Notice: Subject to any disclaimer, the term of this patent is extended or adjusted under 35 U.S.C. 154(b) by 1196 days.

(21) Appl. No.: 11/966,501

(22) Filed: Dec. 28, 2007

(65) Prior Publication Data

US 2011/0181482 A1 Jul. 28, 2011

(30) Foreign Application Priority Data

Mar. 30, 2007 (GB) ..... 0706296.1

(51) Int. Cl.
*H01Q 13/18* (2006.01)
*H01Q 21/00* (2006.01)

(52) U.S. Cl.
USPC ..... 343/770; 343/771; 343/767

(58) Field of Classification Search
USPC ..... 343/767–771, 872–873, 898, 702
See application file for complete search history.

(56) References Cited

U.S. PATENT DOCUMENTS

| | | | | |
|---|---|---|---|---|
| 2,756,421 | A | 7/1956 | Harvey et al. | |
| 2,774,068 | A * | 12/1956 | Haagensen | 343/770 |
| 2,947,988 | A | 8/1960 | Masters | |
| 5,220,337 | A | 6/1993 | Ajioka | |
| 5,546,096 | A | 8/1996 | Wada | |
| 5,559,523 | A | 9/1996 | Smith et al. | |
| 5,757,333 | A | 5/1998 | Kitchener | |
| 5,929,821 | A | 7/1999 | Goldstein et al. | |
| 5,995,065 | A | 11/1999 | Kitchener et al. | |
| 5,999,132 | A | 12/1999 | Kitchener et al. | |
| 6,008,763 | A * | 12/1999 | Nystrom et al. | 343/700 MS |
| 6,018,324 | A | 1/2000 | Kitchener | |
| 6,046,700 | A | 4/2000 | Kitchener et al. | |
| 6,137,448 | A | 10/2000 | Schadler | |
| 6,211,841 | B1 | 4/2001 | Smith et al. | |
| 6,426,723 | B1 | 7/2002 | Smith et al. | |
| 7,091,918 | B1 | 8/2006 | Bhansali et al. | |
| 7,205,952 | B2 | 4/2007 | Harris | |
| 7,355,555 | B2 | 4/2008 | Kitchener et al. | |
| 2003/0080913 | A1 | 5/2003 | Harris | |
| 2006/0284778 | A1 * | 12/2006 | Sanford et al. | 343/770 |
| 2007/0057859 | A1 * | 3/2007 | Kitchener et al. | 343/770 |

* cited by examiner

*Primary Examiner* — Jacob Y Choi
*Assistant Examiner* — Amal Patel
(74) *Attorney, Agent, or Firm* — Meyertons, Hood, Kivlin, Kowert & Goetzel, P.C.; Eric B. Meyertons

(57) ABSTRACT

Embodiments of the invention relate to an antenna structure and are particularly suited to array antennas. An antenna according to an embodiment of the invention employs an enclosure having an aperture in one end; in preferred arrangements the aperture provides the enclosure with a substantially open end, over which the cover is placed. The cover has a slot therein, of a smaller size than the size of the aperture presented by the open ended enclosure and the slot in the cover then acts as the radiating slot.

22 Claims, 13 Drawing Sheets

ANTENNA STRUCTURES AND ARRAYS

FIELD OF THE INVENTION

The present invention relates to an antenna element and to an array of antenna elements, and is particularly, but not exclusively suited to cavity-backed, slot-radiating type.

BACKGROUND OF THE INVENTION

Modern wireless communications systems place great demands on the antennas used to transmit and receive signals, especially at cellular wireless base stations. Antennas are required to produce a carefully tailored radiation pattern with a defined beamwidth in azimuth, so that, for example, the wireless cellular coverage area has a controlled overlap with the coverage area of other antennas. The antennas may be deployed, for example, in a tri-cellular arrangement or, with a narrower beamwidth, as a six-sectored arrangement.

In addition to a defined azimuth beam, such antennas are also required to produce a precisely defined beam pattern in elevation; in fact the elevation beam is generally required to be narrower than the azimuth beam.

It is conventional to construct such antennas as an array of antenna elements to form the required beam patterns. Such arrays require a feed network in order to energise the antenna elements: on transmission, the feed network splits signals into components with whichever phase relationship is required to drive the antenna elements, and on reception, the feed network functions as a combiner. An array consisting of a single vertical column of antenna elements is commonly used at cellular radio base stations with a tri-cellular cell pattern. Similar arrays, but with two or more columns may be deployed if narrower azimuth beams are required. Generally, it is desirable to place antenna elements no more than approximately a half wavelength apart in azimuth at the carrier frequency under consideration to avoid generating grating lobes in the antenna pattern with associated unwanted nulls. It can be demanding to produce antenna elements physically small enough to be placed in an array on a half wavelength grid.

In addition the antenna should be capable of withstanding the environmental conditions experienced on the top of a mast, such as temperature extremes and wind loading, while being cheap to produce and light in weight to ease installation.

A design for an array antenna is described in the applicant's co-pending international patent application publication number WO 2007/031706; this design provides an antenna array having an electrically conductive tube (or cylinder), an electrically conductive outer surface, and a feed layer located between the tube and the outer surface. The antenna array is arranged to carry electrically conductive tracks, and houses dielectric material between the tube and the feed layer and between the outer surface and the feed layer. The antenna comprises a plurality of radiating elements formed as slots that are defined by areas of non-conductivity in both the front face of the outer surface and in the tube which are in registry with one another, the slots being energised in use by respective conductive tracks defined on the feed layer which are generally in registry with the slots.

In this design, the electrically conductive tube or cylinder—typically rectangular—may be made of a light weight plastics material with an electrically conductive coating with slots in the front face of the tube and ribs within the tube forming relatively closed cavities behind the slots. The tube therefore defines a relatively closed, compartmentalised but partially hollow structure. This presents some difficulty in manufacture because it is difficult to manufacture such structures as one-piece mouldings; as a result the antenna is likely to be moulded from two separate pieces, which are joined together to form the tube. This is a relatively expensive and time consuming.

It can be seen that there are many challenges to be faced when designing an antenna that produces a desired radiation pattern while being low cost and lightweight.

SUMMARY OF THE INVENTION

In accordance with a first aspect of the present invention, there is provided an antenna comprising:

an electrically conductive enclosure with a non-conducting aperture formed in an end thereof;

an electrically conductive cover comprising a first portion covering at least part of said end of the enclosure and a second portion covering at least part of a side of the enclosure;

a feed layer located between the enclosure and said first portion of the cover and arranged to carry electrically conductive track; and a radiating element formed as a slot defined by an area of non-conductivity within said first portion of the cover, the slot being energised in use by a radiating portion of the track defined on the feed layer, said radiating portion being generally in registry with the slot, wherein the non-conducting aperture formed in said end of the enclosure is of a larger area than that of the slot defined in the cover.

In embodiments of the invention the antenna array is provided by an enclosure with an open or partially open end and a cover with a slot; the combination of enclosure and cover provide a cavity, and the feed layer forms a cavity-backed, slot-radiating antenna element having a closed structure. In arrangements in which the aperture extends to the sides of the enclosure, a portion of the cover—namely that extending along the sides of the enclosure—forms part of the wall of the cavity. An advantage of such an arrangement is that the enclosure can be easily moulded.

In some arrangements parts of some of the walls of the enclosure include fence structures which extend beyond the plane of the aperture towards, but not abutting, the cover. Thus when assembled, there is a gap between these fence structures and an internal face of the cover; this arrangement allows capacitative coupling between the fence structure and the cover, while the fence structures themselves increase the isolation between antenna elements when combined as an array. The size of the gap contributes to the isolation provided by the fence structure, and functions to prevent passive intermodulation distortion that may be cause by contact between conducting structures.

Conveniently, a dielectric material is located within the cavity, or outside of the cavity, to allow the physical size of the enclosure to be reduced compared with an enclosure designed for operation at the same radio frequency without dielectric material located in the cavity.

Preferably, the cover is extended to protrude beyond the side walls of the enclosure so that the ground plane formed by the surface of the cover surrounding the slot is extended; this has the effect of narrowing the beam formed by the antenna. A narrower beam may be desirable in some applications, such as a tri-cellular sector antenna in a cellular wireless system.

According to a second aspect of the invention, an array of antenna elements may be formed by an enclosure with internal walls, thereby forming an array of cavities. The array is covered by a cover in which slots are formed, and the slots are energised by a feed layer between the cover and the enclosure as described above. Conveniently, the feed layer is extended so that a portion lies between the side of the enclosure and the cover. This has the benefit that radio signals can be routed through this feed layer to respective antenna elements. Conventional printed stripline components such as filters and couplers can conveniently be formed on the feed layer in this region. This has the benefit of providing a convenient means of replacing external components that would otherwise be required to form a feed network.

Preferably, a second feed layer is inserted above the first feed layer in the region between the enclosure and the cover. This can be used to form overlay couplers, that is regions of track of approximately a quarter wavelength in length that run one above the other. The benefit of an overlay coupler is that it allows connection to the feed layer without a metal-to-metal contact; since the feed layer energises the slots, avoiding metal-to-metal contact is desirable since it minimises passive intermodulation distortion and simplifies construction.

According to a further aspect of the invention, an antenna array is formed in a modular fashion, by associating multiple antenna array enclosures and associated feed networks to a single cover formed from an integral sheet. This has structural benefits since the cover provides rigidity and can typically be easily made as one piece.

Figure 2:
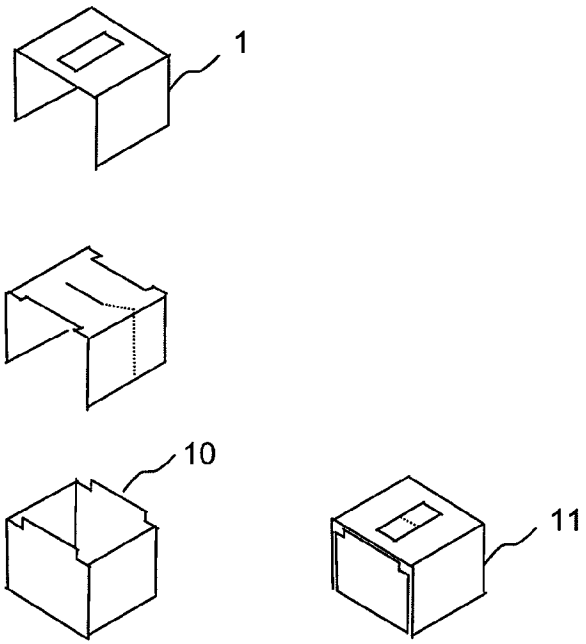
FIG. 2 is a schematic diagram showing the construction of the single antenna element shown in FIG. 1 including a fence structure.

Several parts and components of the invention appear in more than one Figure; for the sake of clarity the same reference numeral will be used to refer to the same part and component in all of the Figures. In addition, certain parts are referenced by means of a number and one or more suffixes, indicating that the part comprises a sequence of elements (each suffix indicating an individual element in the sequence). For clarity, when there is a reference to the sequence per se the suffix is omitted, but when there is a reference to individual elements within the sequence the suffix is included.

DETAILED DESCRIPTION OF THE INVENTION

For clarity, the methods and apparatus are described in the context of an antenna system suitable for use with a cellular wireless base station. However, it is to be understood that the invention is not limited to such an application. For example, the present invention may be applied to wireless systems other than cellular systems, and the antenna elements may be used singly or as arrays of antennas in any configuration.

Figure 1:
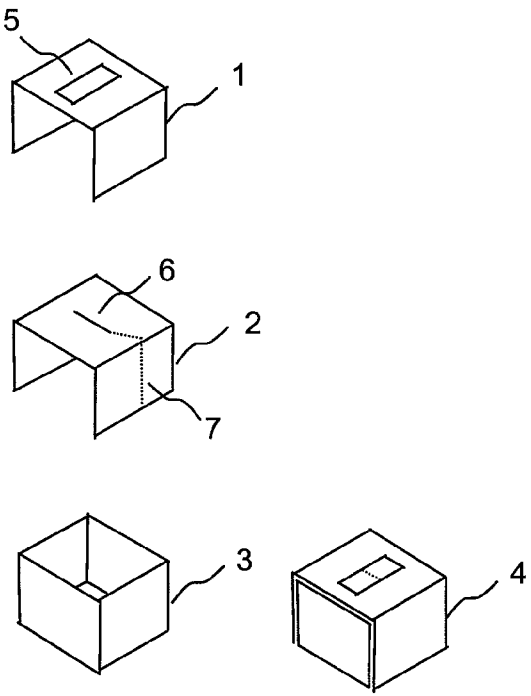
FIG. 1 is a schematic diagram showing the construction of a single antenna element according to an embodiment of the invention.

FIG. 1 illustrates a first embodiment of the invention, showing the construction of a single antenna element 4. An electrically conductive enclosure 3 such as a box structure comprises an open end so as to form an open cavity. An electrically conductive cover 1 is provided for the structure 3 and, when in position, the cover 1 covers the open end of the structure 3. The cover 1 can also partially or wholly cover one or two of the outer side walls of the structure. The cover has a slot 5 which is associated with the cavity of the structure 3. A feed layer 2 is located between the structure 3 and the cover 1 and is arranged to carry an electrically conductive track 7 with a radiating portion 6. The combination of cover 1 with slot 5, feed layer 2 and open end in the structure 3 forms a single cavity-backed, slot-radiating antenna element 4 having a closed structure.

As the enclosure 3 may remain open on one end, the enclosure may be moulded in one piece, preferably from a plastics material which can be coated with an electrically conductive material. Alternatively, the structure may be made from electrically conductive material such as aluminium, another metal or a composite material. Preferably, the cover 1 is made from an electrically conductive material such as aluminium, another metal such as steel or a composite material. The shape of the cover is relatively easy to form from sheet material for example, by stamping and folding operations. Alternatively, the cover may be made from a plastics material which is coated with an electrically conductive material.

An antenna 4 formed from the structure 3, feed layer 2 and cover 1 may define a single antenna module 4 for an antenna array comprising two or more such modules 4. A module may consist of any number of antenna elements; the choice of number of elements may be influenced by such factors as limitations in manufacturing technology in producing a module above a certain size, and indeed on the number of elements required in antenna array. Antenna modules may be fixed together to form arrays of antennas having virtually any two-dimensional arrangement of antenna elements. Indeed, in some arrangements a three dimensional arrangement may be desired. Preferably, fixing elements are used to permit easy assembly of antenna arrays together. The fixing elements on one module cooperate with those on another to fix the modules in place with each other. Fixings need not be electrically conductive; in many cases it is sufficient that the box structures are capacitatively coupled together by means of gaps of less than approximately a millimeter between adjacent faces of the box structures.

The feed network for the radiating slot elements can be formed from electrically conductive stripline tracks on a plastic (for example Mylar) layer 2 that is sandwiched between the cover 1 and the structure 3. In international patent application having publication number WO 2007/031706 (introduced above) the electrically conductive feed elements form T-bars within the dog-bone shaped slots. In embodiments of the present invention, the feed element 6 within the slot 5 is linear and is preferably oriented perpendicular to a longest side of the rectangular slot 5. The feed element 6 can be in registration with the slot 5 and is arranged to have suitable dimensions and position to match the electrical impedance of the feed network to the slot. Such a feed structure improves the efficiency of energy transmission to the cavities.

In preferred arrangements, the end walls and any internal walls of the structure extend slightly beyond the plane of the open side of the box. These extensions are known as fence structures 10 as shown in FIG. 2.

By limiting protrusions to the end and internal walls, access for the feed network can be provided in the feed layer over the side walls. Whilst this is a preferred arrangement, it will be appreciated that the fence structures 10 may be provided in any of the walls of the structure, provided they are configured so as to allow access for the feed network in the feed layer. FIG. 2 illustrates a preferred arrangement of the fence structure 10 in assembled antenna element 11, in which there is a gap between the fence structure 10 and the cover 1. The gap should as small as possible consistent with production tolerances and environmental stresses. A gap of 2 mm or less is typically provided, although larger gaps would provide some benefit.

The purpose of the deliberate gap is to minimise the generation of passive intermodulation products (PIM). PIM can potentially cause radio interference and non-linear effects, especially but not only in frequency duplexed systems. PIM occurs when an electrical connection is not firmly made, and can, for example, be caused by an oxide layer existing between the conductors. This positioning requirement can be achieved by the fence structure being either secured relative to the cover, for example by screw fixings, or else maintaining a small gap as shown in FIG. 2. For the purposes of PIM minimisation and mechanical ease of construction, the maintenance of a small gap is preferred over the screw-fixed embodiment.

Figure 3:
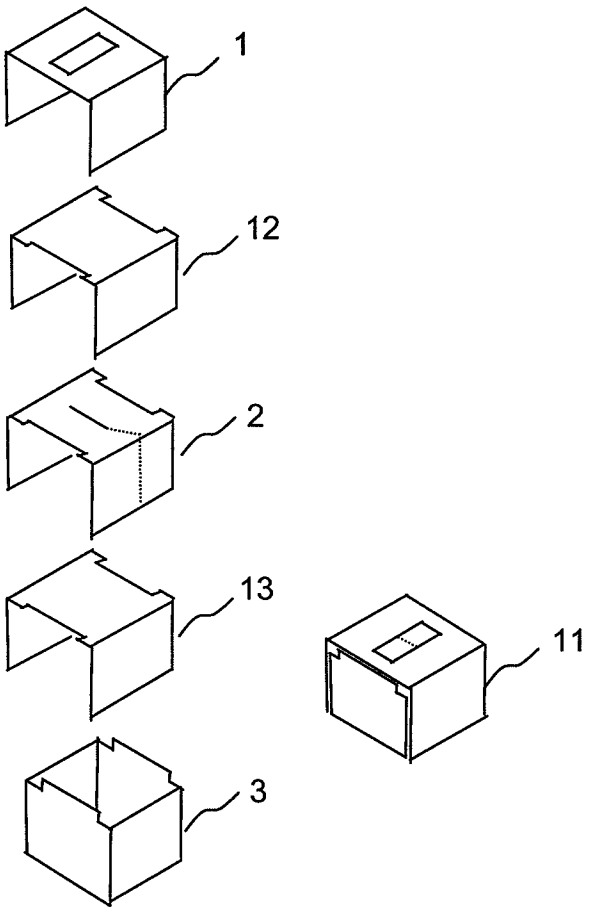
FIG. 3 is a schematic diagram showing the construction of the single antenna element shown in FIG. 1 including dielectric foam layers.

FIG. 3 shows the inclusion of a dielectric material such as foam, preferably in the form of a sheet 12, 13, between the structure 3 and the feed layer 2 and between the cover 1 and the feed layer 2 in order to locate the feed layer 2. The function of the dielectric layer 12, 13 is to maintain the feed layer in position relative to the box and the cover, in particular in terms of maintaining the distance between the enclosure and the feed layer and between the cover 1 and the feed layer 2.

Figure 4:
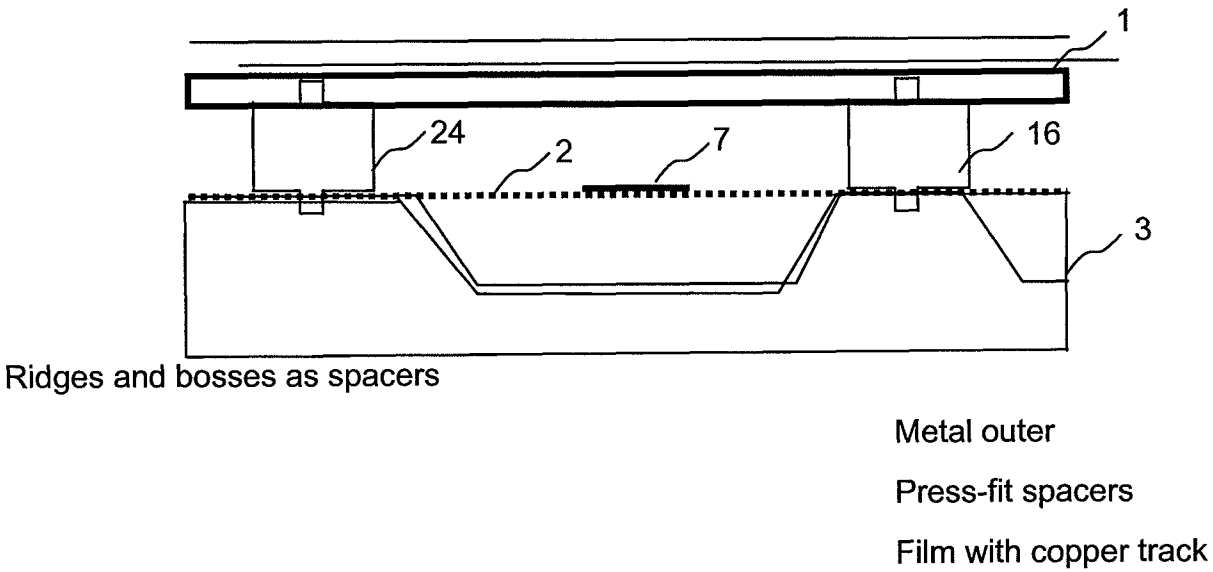
FIG. 4 is a schematic diagram showing a mounting technique for the feed layer according to an embodiment of the invention.

Alternatively, as shown in FIG. 4, the feed layer 2 may be located between the enclosure 3 and outer cover 1 by means of mechanical spacers 16, 24, such that the dielectric surrounding the feed layer is air. The shaping of the enclosure 3 is preferably arranged such that the spacers 16 and 24 are located at least a track-width from any conductive tracks 7. A construction such as this may be easier to assemble than would be the case were a foam layer used; in terms of radio frequency performance, the two approaches are similar since the dielectric properties of foam are typically very similar to those of air.

Figure 5A:
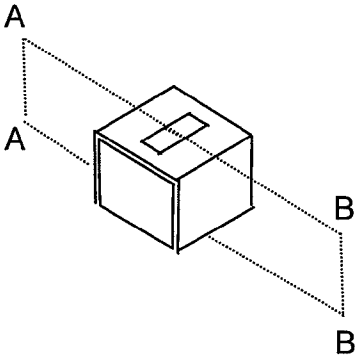
FIG. 5*a* is a schematic diagram showing the position of the cross section through the single antenna element shown in FIG. 1.
Figure 5B:
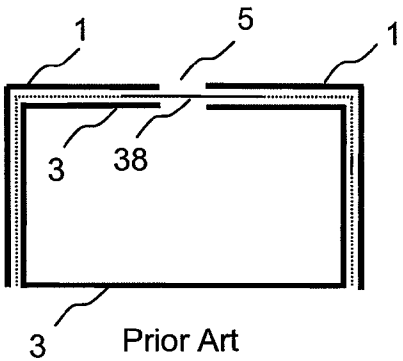
FIG. 5*b* is a schematic diagram showing a cross-section of a conventional antenna element.
Figure 5C:
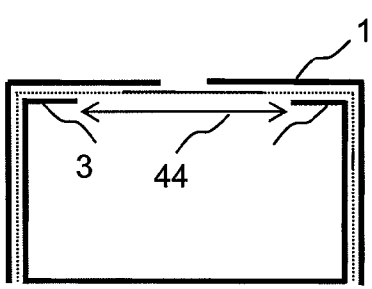
FIG. 5*c* is a schematic diagram showing a cross-section of an antenna element in a first arrangement.
Figure 5D:
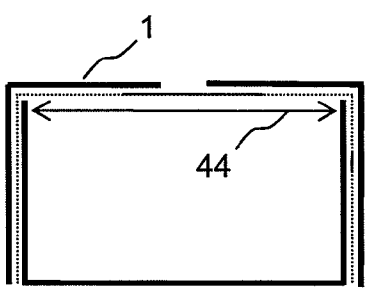
FIG. 5*d* is a schematic diagram showing a cross-section of an antenna element in a second arrangement.

FIG. 5*a* illustrates the plane AA-BB in respect of which cross-sections of a single antenna element are shown in FIGS. 5*b*, 5*c* and 5*d*. FIG. 5*b* shows a cross-section of a conventional antenna element as described in WO 2007/031706, mentioned above. FIG. 5*c* shows a cross section through an antenna element that is an embodiment of the current invention; it can be seen that the aperture 44 in the enclosure 3 is typically greater in size in this cross-section than the size of the aperture in the cover 1. FIG. 5*d* shows a preferred embodiment of the invention; in this case the aperture 44 extends from side to side of the enclosure 3. This arrangement shown in FIG. 5*d* is preferable as the enclosure 3 can then be easily formed by a moulding process unlike conventional structures 3 shown in FIG. 5*b*.

Figure 6:
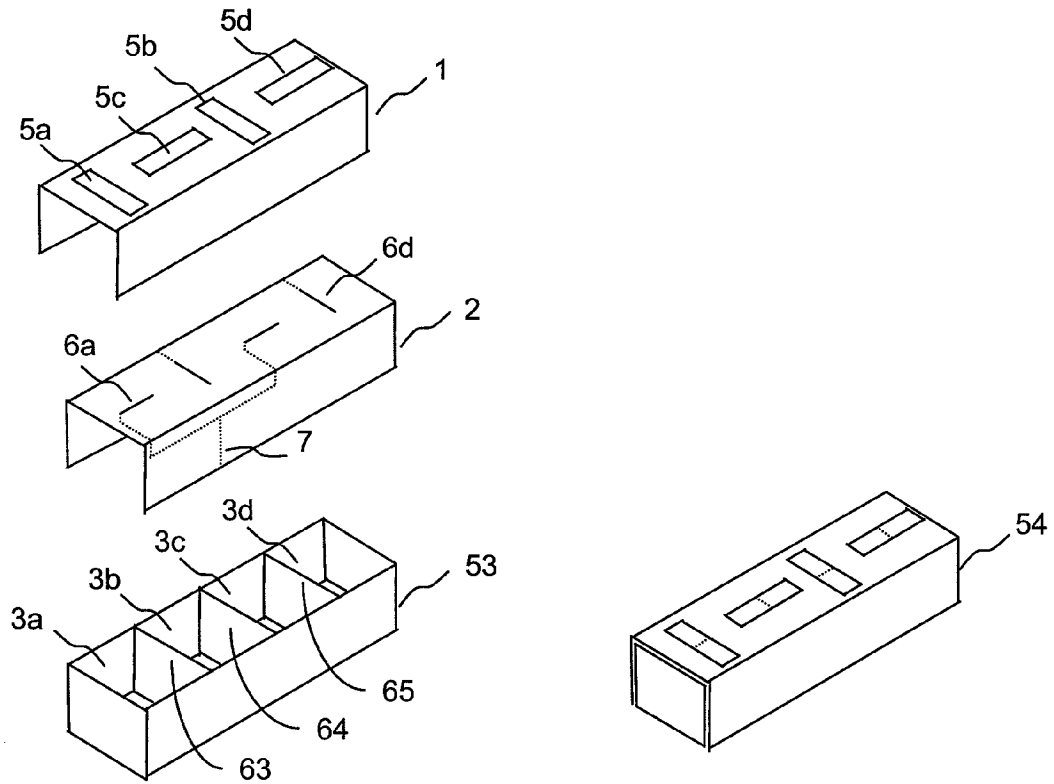
FIG. 6 is a schematic diagram showing the construction of an array of antenna elements according to an embodiment of the invention.

As a further embodiment, a plurality of antenna elements may be combined in a structure as shown in FIG. 6. In this example, four antenna elements 3*a* . . . 3*d* are shown combined into mechanical structure 54. Two elements associated with slots 5*a*, 5*b* are vertically polarised (arbitrary designation of polarisation state) and two elements associated with slots 5*c*, 5*d* are polarised orthogonally to these, designated as horizontally polarised. It is possible for the slots 5*a* . . . 5*d* to be arranged in any orientation with respect to the axis of the cover, provided that the radiating portions (for example 6*a*, 6*d*) of the conductive tracks are arranged to be in registration with the slots. An enclosure 53 is open on one side and is compartmentalised by having, in this example, three internal walls 63, 64 and 65 forming four open cavities within the structure 53. The open cavities in the enclosure may form rectangular open boxes 3*a* . . . 3*d*, each corresponding to an antenna element. As for the single antenna element structure, this openness of the structure therefore of itself does not provide slots forming radiating elements in front of the cavities. A cover 1 is provided for the structure and located over the open side of the structure when the cover is in place. The cover 1 has slots 5*a* . . . 5*d* which correspond to the cavities of the structure. The cover 1 may also partially or wholly cover one or two of the outer side walls of the structure. A feed layer 2 is located between the structure and the cover and arranged to carry electrically conductive tracks 7.

Figure 7B:
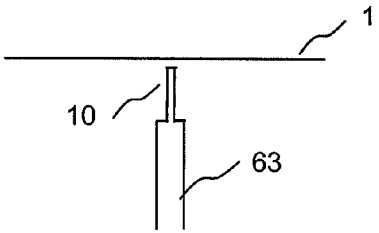
FIG. 7*b* is a schematic diagram showing detail of the construction of a fence structure.
Figure 7A:
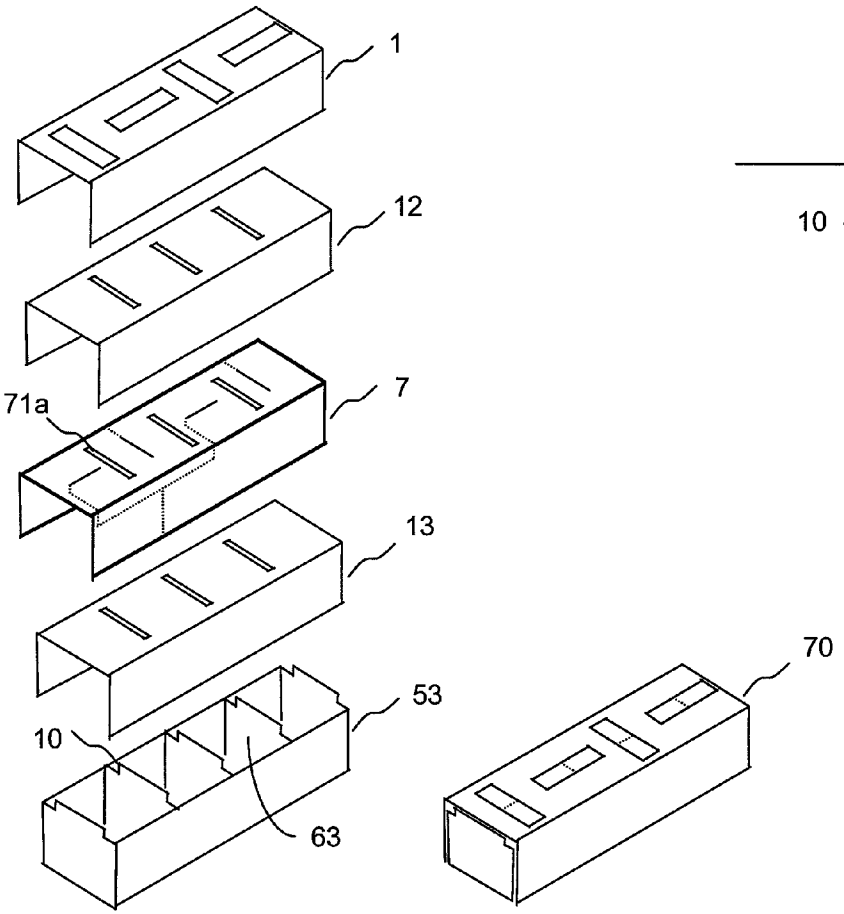
FIG. 7*a* is a schematic diagram showing the construction of an array of antenna elements according to an embodiment of the invention with dielectric foam layer and fence structures.

FIG. 7*a* illustrates the application of a fence structure 10 to a four element antenna array 70. Preferably, only a smaller cross section of the end and internal walls are extended by means of fence structures, as illustrated by FIG. 7*b*. In FIG. 7*b*, an internal wall 63 of the box 53 is shown in cross-section together with the fence structure 10; it can be seen that the fence structure 10 has a smaller cross section than that of the wall 63. It can be appreciated from FIG. 7*a* that corresponding gaps in the feed layer 2 and dielectric material 12, 13 located between the structure and the feed layer 2 and between the cover 1 and the feed layer 2 are provided to accommodate the extensions. As an illustration, fence structure 10 protrudes through slots in the dielectric and feed layers by means of aperture 71*a* provided in the feed layer 2. The feed layer 2 and dielectric layers 12, 13 therefore may be positioned accurately and securely.

As described above, the extensions provided by the fence structures 10 serve to provide increased RF isolation between adjacent cavities (whether in the same antenna module or between antenna elements in adjacent modules) which improves efficiency and performance.

Figure 8:
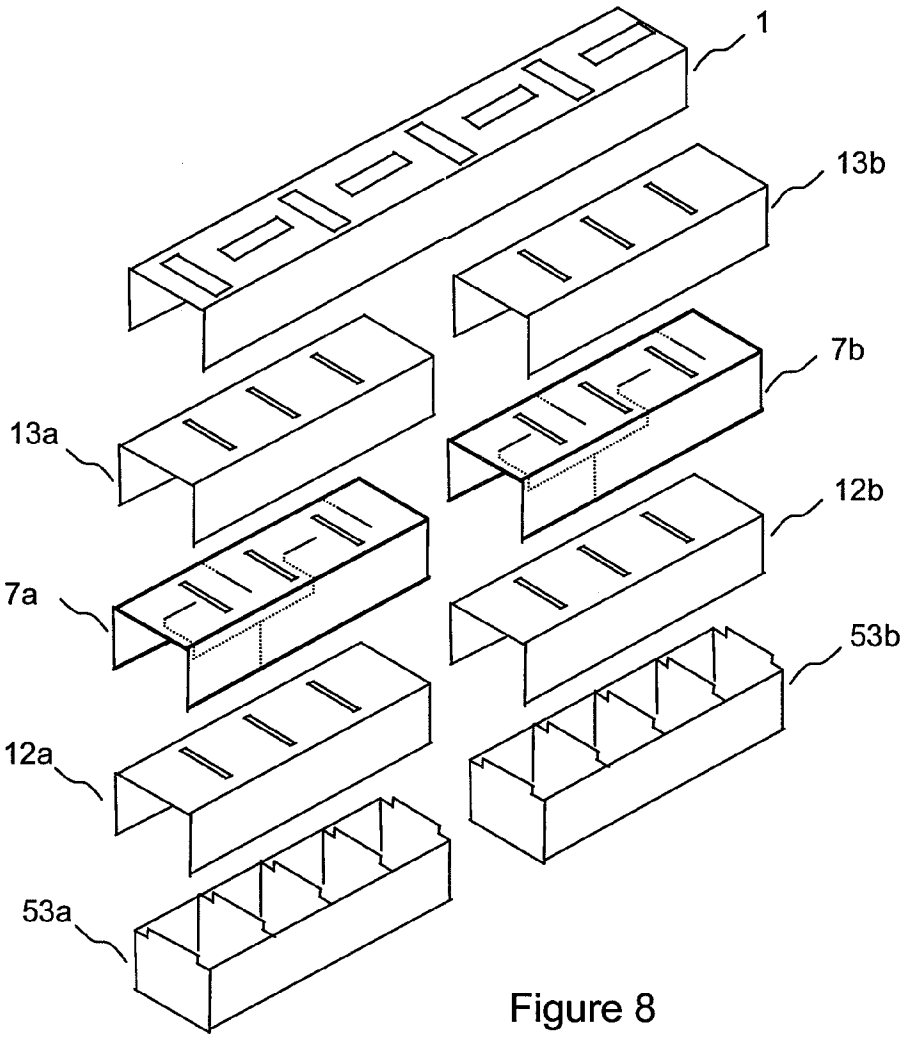
FIG. 8 is a schematic diagram showing the construction of an extended array of antenna elements according to an embodiment of the invention.

FIG. 8 illustrates an embodiment of an antenna array constructed in modular form. In this case, eight antenna elements of alternate vertical and horizontal polarisation are formed using a single cover 1 and modular parts for cavity enclosures 53*a*, 53*b*, feed layer 7*a*, 7*b* and foam dielectric layers 12*a*, 12*b* and 13*a*, 13*b*. As described above, spacers may be used as an alternative to the foam dielectric layer. In the structure of FIG. 8 the cover 1 acts as a frame to support the other modules. In one embodiment, the cover 1 is constructed of a metal such as aluminium, which can be produced easily and cheaply in this form by stamping and bending operations. Alternative materials could be used, for example other metals such as steel or composite materials or other non-conductive materials with a conductive coating. It may be straightforward to manufacture the cover in a single piece, whereas the enclosure 53*a*, 53*b* may be for example injection moulded, in which case the difficulty and cost of moulding increases with the size of the item. Similarly, the feed layers 7*a*, 7*b* may be manufactured using a sheet of material of a limited size, so that it is advantageous to limit the size of this item to that of a module as illustrated.

As has been discussed, the slots 5*a* . . . 5*d* in the cover may be alternate vertical (V) and horizontal (H) slots thereby forming cross-polar antenna elements. Alternatively, the slots may be a +45 degrees and −45 degrees to the vertical or at other orientations. The slots may be rectangular lozenge shaped. Where cavities of the structure form open rectangular boxes, the slots of the cover when fitted will be parallel to the side or end/internal walls of the open rectangular box cavities.

Figure 9C:
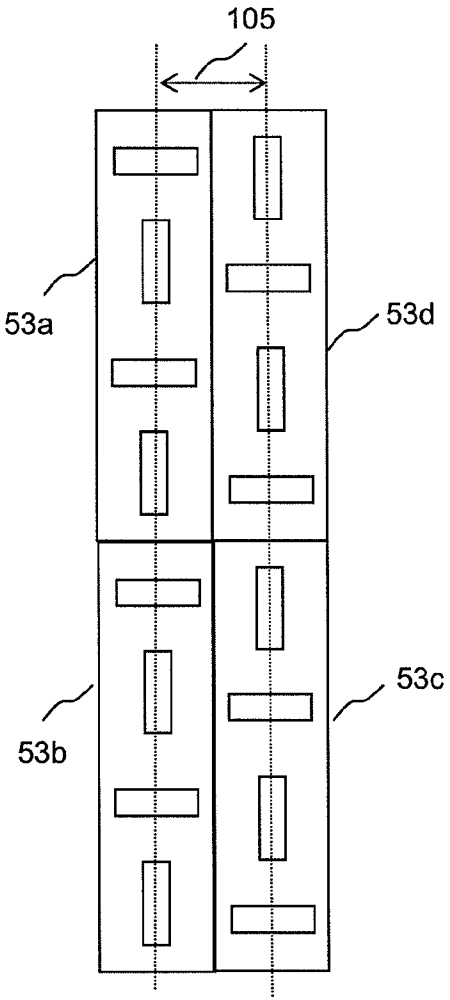
FIG. 9*c* is a schematic diagram showing a vertical and horizontal array of vertically and horizontally polarised slots in a cover according to an embodiment of the invention.
Figure 9B:
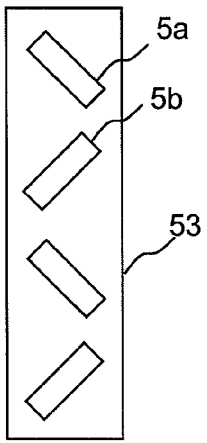
FIG. 9*b* is a schematic diagram showing an arrangement slots in a cover according to an embodiment of the invention at polarisations of +/−45 degrees.
Figure 9A:
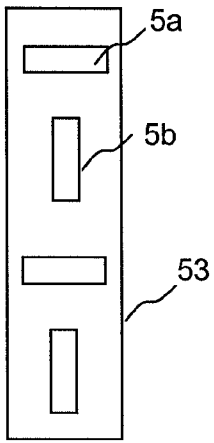
FIG. 9*a* is a schematic diagram showing an arrangement of vertically and horizontally polarised slots in a cover according to an embodiment of the invention.

FIG. 9*a*, FIG. 9*b* and FIG. 9*c* illustrate examples of antenna array configurations. There are many possibilities in addition to those illustrated. For example, a single module may have two slots, e.g. a V and H or +45/−45 degree cross polar elements, or 4 slots, e.g. V and H (as illustrated in FIG. 9*a*) or +45/−45 degree cross polar elements (as illustrated in FIG. 9*b*), or a single polar element (one slot). When using a two V and H cross polar elements (4 slots), the following antenna arrays may be built: a 4× cross polar element linear antenna array (two modules end on end); 8× cross polar element linear antenna array (four modules end on end); a 2×2 cross polar element two dimensional array (two modules side by side); 2×4 cross polar element two dimensional array (four modules in a 2×2 matrix) as illustrated in FIG. 9*c*; and a 4×4 cross polar element two dimensional array (eight modules in a 2×4 matrix). In the latter two cases, alternate ones of the side by side modules may be rotated through 180 degrees to give an alternating V and H slots in both directions of the two-dimensional array; such an arrangement is illustrated in FIG. 9*c*; modules 53*a* and 53*b* are in opposite orientation to modules 53*c* and 53*d*.

The spacing between slots in azimuth is relevant to the operation of the array. Many arrays require a spacing of as little as half a wavelength at the radiated frequency. It is assumed in this example that the array will be deployed with the long axis approximately vertical, so that the measurement 105 represents the spacing in azimuth. Preferably the dimension 105 does not exceed approximately half a wavelength so as to accommodate the design requirements of the components of the module.

By using one or more standard modular elements, manufacturing economies of scale may be achieved for the modules, while permitting many different antenna array arrangements to be assembled for different purposes, thereby providing a flexible and relatively cheap antenna structure.

In preferred embodiments, dielectric material (other than air) may be placed in the open cavity or cavities of the structure. The material may, for example, be placed alongside one, or two opposite, walls of the open cavities. This increases the effective width or height of the cavities as regards the radio frequency (RF) waves resonating in the cavity (e.g. by increasing the electro-magnetic width of the cavities) and thus enables a shorter width or height cavity structure while maintaining the desired resonant frequency for the antenna element. Thus a more compact antenna structure may be achieved. Furthermore, with two-dimensional arrayed antennas required for the purposes of beam forming, as already mentioned, there is a further constraint that the width of each horizontal column of the array should be less than or equal to half the carrier frequency wavelength to enable directed RF beams without grating lobes. Dielectric loading of the cavity of the structure enables the desired resonant frequency to be provided, while meeting the column width constraint for the antennas. This is particularly important for higher frequency (shorter wavelength) bands such as the WiMAX and AWS frequency bands; the spacing between the cover and the enclosure does not scale with frequency, so that this forms a larger proportion of the column width in shorter wavelength systems, leaving a smaller proportion of the width for the cavity.

Figure 10C:
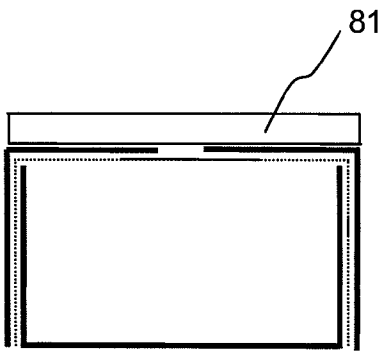
FIG. 10*c* is a schematic diagram showing a third arrangement of dielectric loading on an antenna according to an embodiment of the invention.
Figure 10B:
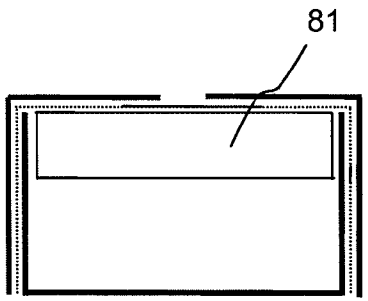
FIG. 10*b* is a schematic diagram showing a second arrangement of dielectric loading on an antenna according to an embodiment of the invention.
Figure 10A:
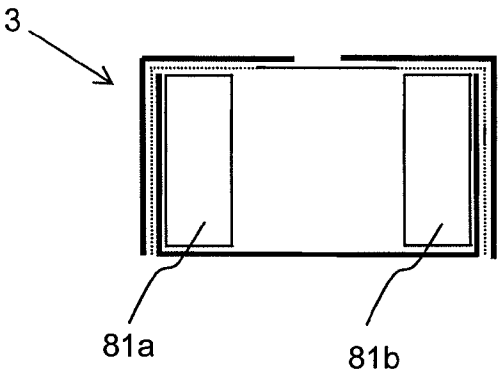
FIG. 10*a* is a schematic diagram showing a first arrangement of dielectric loading on an antenna according to an embodiment of the invention.

FIGS. 10*a*, 10*b* and 10*c* illustrate alternative arrangements of dielectric material with respect to the antenna structure. In FIG. 8*a*, dielectric blocks 81*a*, 81*b* are shown placed in the enclosure 3 at opposite sides of the enclosure, whereas in FIG. 8*b* the dielectric material 81 is placed underneath the slot. Other positions and combinations of positions are possible; the examples shown are for illustration only, and indeed the dielectric need not be formed into rectangular blocks as shown, but could be formed into a variety of shapes. The whole cavity or any part of it may be filled with dielectric material. The choice of material is dependent on factors such as the dielectric constant and loss tangent of the material and its cost and mechanical properties. In preferred embodiments, dielectric material 81 may be placed externally in front of the cover as shown in FIG. 10*c*. This may be in addition to the internal dielectric material described above. This serves to alter the electro-magnetic dimensions of the slots and enables more flexibility in choosing the physical dimensions of the slots. This external dielectric material may also serve as a radome, a structure giving waterproofing and mechanical protection to the antenna.

Figure 11:
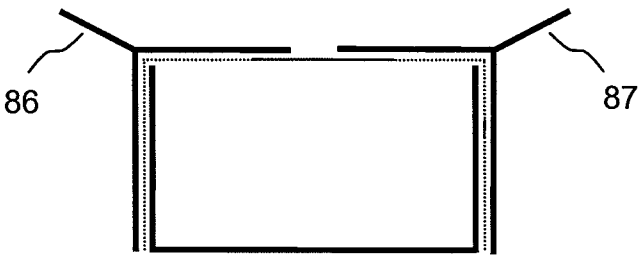
FIG. 11 is a schematic diagram showing the addition of shutters to an antenna element according to an embodiment of the invention.

The beamwidth of an antenna formed with this structure can be modified by placing conducting surfaces immediately alongside the external cover. This is illustrated by FIG. 11. In the case of a single column of antenna elements of this type the adjacent structures may take the form of angled conducting shutters 86 and 87 that control the beamwidth to a desired value by modifying the extent of the electrical aperture of the antenna. The shutters can be of various sizes, shapes or orientations. As illustrated in FIG. 11, the shutters 86 and 87 are arranged at an angle to the top face of the cover; the angle and the size of the shutter are determined by modelling the performance of the antenna or by empirical measurements and the physical parameters are chosen to produce the desired beamwidth. Typically, a larger width of the ground plane represented by the top face of the cover plus the shutters will produce a narrower beam.

Figure 12:
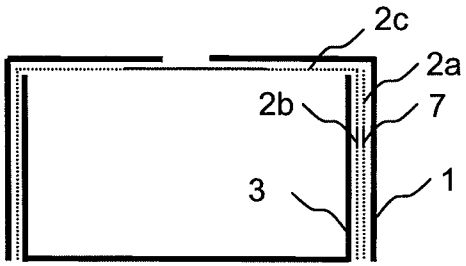
FIG. 12 is a schematic diagram showing a cross section of an antenna element according to an embodiment of the invention with an additional feed layer.

FIG. 12 shows an embodiment in which two feed layers 2*a*, 2*b* are arranged between a side of the enclosure 3 and the cover 1. Foam dielectric may be added between feed layer 2*a* and the enclosure 3 and between feed layer 2*b* and the cover 1. Alternatively, mechanical spacers may be used to hold the two feed layers in contact with each other and roughly midway between the enclosure and the cover. Feed layer 2*a* or 2*b* may be made as a portion of feed layer 2*c*. Conductive tracks 7 are formed on one side of feed layer 2*a* and the feed layer is orientated so that tracks on one feed layer are not in contact with tracks on the other feed layer. That is, either the substrate sides of the feed layers 2*a*, 2*b* are in contact with each other or the track side of one is in contact with the substrate side of the other. In either case, a broadside coupler can be formed comprising the enclosure 3 and the cover 1 acting as ground planes and further comprising tracks sections of approximately a quarter wavelength in length on each layer 2*a*, 2*b* in registration with each other. The wavelength referred to here is that corresponding to approximately the centre frequency of the operating band of the antenna in the dielectric material constituting the feed layer substrate.

Figure 13A:
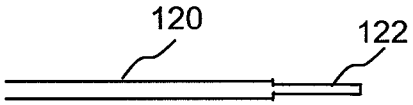
FIG. 13*a* is a schematic diagram showing a conductive track on an upper feed layer as part of a coupler structure.
Figure 13B:
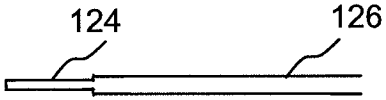
FIG. 13*b* is a schematic diagram showing a conductive track on a lower feed layer as part of a coupler structure.
Figure 13C:
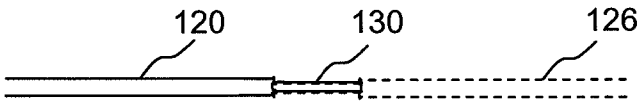
FIG. 13*c* is a schematic diagram showing conductive tracks on an upper and lower feed layer overlaid as a coupler structure.
Figure 13D:
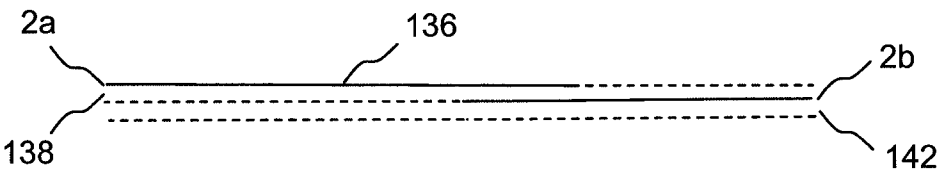
FIG. 13*d* is a schematic diagram showing conductive tracks on an upper and lower feed layer overlaid as a coupler structure in cross-section.

FIGS. 13*a*, 13*b*, 13*c* and 13*d* illustrate the construction of a suitable coupler, for example an overlay coupler. FIG. 13*a* shows the conductive track formed on a feed layer 2*a*, 2*b* shown in FIG. 2. Section 120 is a stripline track designed to exhibit a suitable characteristic impedance to match other parts of the feed network; typically 50 Ohms is used. Section 122 is typically narrowed to produce an overlay coupler when used in conjunction of the similar section 124 on layer 2*b*, as shown in FIG. 13*b*. The calculation of the necessary width of the tracks is performed using well known relationships or computer modelling techniques. FIG. 13*c* shows the arrangement of the tracks on layers 2*a* and 2*b* overlaid in registration with one another in plan view. The overlay coupler is formed as shown by part 130. FIG. 13*c* shows a cross-section through the two overlaid tracks. The substrate material of layer 2*a* is shown at 138 and that of layer 2*b* is shown at 142. The substrate may, for example, be a polyester film.

A coupler such as that illustrated in FIGS. 13*a*, 13*b*, 13*c* and 13*d* could be used to connect tracks formed on separate pieces of feed layer; for example as a method of interconnecting RF signals between modules 53*a*, 53*b*. The lack of contact between metallic components is advantageous in terms of removing a potential source of passive intermodulation, as discussed above.

In addition, conventional stripline components such as filters could be constructed on one or both of layers 2*a* and 2*b*.

Figure 14A:
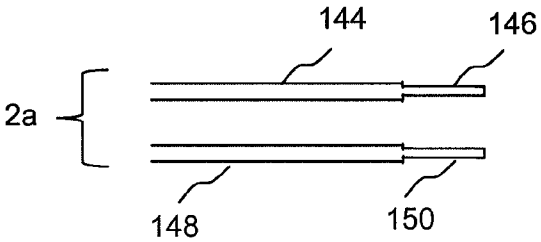
FIG. 14*a* is a schematic diagram showing conductive tracks on an upper feed layer as part of a variable phase shifter structure.
Figure 14B:
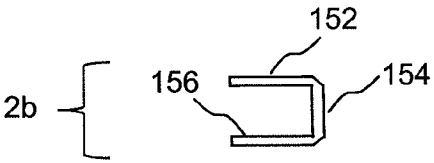
FIG. 14*b* is a schematic diagram showing conductive tracks on a lower feed layer as part of a variable phase shifter structure.
Figure 14C:
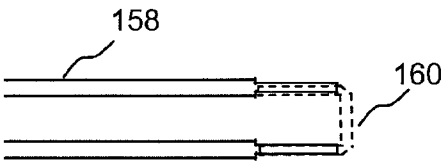
FIG. 14*c* is a schematic diagram showing conductive tracks on an upper and lower feed layer overlaid as a variable phase shifter structure.

It is possible to construct adjustable phase shifters by means of a section of one of the feed layers 2*a* that can be moved relative to the other feed layer 2*b*. An example of such an adjustable phase shifter is shown in FIGS. 14*a*, 14*b* and 14*c*. Variable lengths of line can be constructed using a trombone-like structure as shown in FIG. 14*b*, to which RF signals are coupled using overlay couplers constructed of track sections 146, 152 and 150, 156. FIG. 14*a* shows tracks on one feed layer 2*a* and FIG. 14*b* shows tracks on another feed layer 2*b*. The two layers are shown overlaid in registration with one another in FIG. 14*c*. Preferably, one layer may be positioned relative to the other along the axis of the track section 146. In this way, the path length can be adjusted for a signal entering on track 144, coupled from 146 to 152, transmitted along section 154, then coupled from 156 to 150 and output on track 148. However, the range of adjustment is limited to less than the length of the couplers formed by 146 and 152, as the coupler performance degrades as the sections of track with numerical references 146 and 152 move out of registration.

Figure 15A:
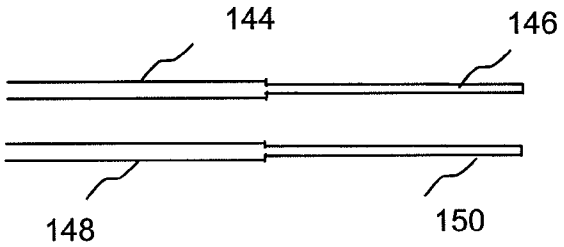
FIG. 15*a* is a schematic diagram showing conductive tracks on an upper feed layer as part of a second variable phase shifter structure.
Figure 15B:
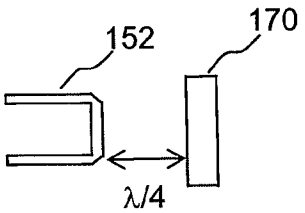
FIG. 15*b* is a schematic diagram showing conductive tracks on a lower feed layer as part of a second variable phase shifter structure.
Figure 15C:
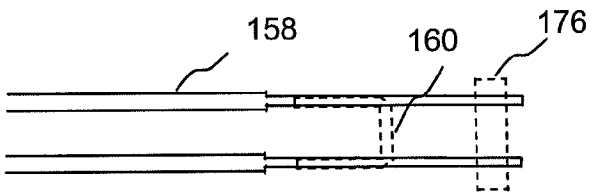
FIG. 15*c* is a schematic diagram showing conductive tracks on an upper and lower feed layer overlaid as a second variable phase shifter structure.

An alternative design of a phase shifter is illustrated in FIGS. 15*a*, 15*b* and 15*c*. The alternative design of phase shifter is constructed by using a similar trombone structure to that discussed above, but with a sliding coupler formed between the trombone 152 and two extended tracks 146, 150. A sliding bar 170, which is formed from conductive tracks or may be a separate electrically conductive component, is capacitatively coupled to signal ground (for example the enclosure or the cover). The sliding bar is connected across the extended tracks 146, 150 and is maintained in a fixed relationship of approximately a quarter wavelength from the cross-piece of the trombone as illustrated in FIG. 15*b*. That is to say, if the trombone 152 is slid along the long axis of extended track 146, the sliding bar will move with it such that its position relative to the trombone does not change. The sliding bar has the effect of minimising reflections that would be caused by the unterminated lengths of line 146 and 150 if the sliding bar were absent. The short circuit at the sliding bar is transformed by the quarter wavelength section of tracks 146 and 150 between the sliding bar and the trombone to an open circuit at the couplers; as a result, substantially no reflections are experienced. The technique of transforming a short circuit to an apparent open circuit using a quarter wavelength section of line is well known in the art.

It is also possible to use the region between the enclosure 3 and the cover 1 to accommodate a well-known design of phase shifter, consisting of a sheet of dielectric that can be slid over a track on the feed layer to increase its electrical length. The sheet of dielectric could be inserted between the feed layer 2 and the open end of the enclosure 3 or between the feed layer 2 and the cover 1, or indeed in both positions. The degree of overlap with the track determines the phase shift experienced.

A wide variety of RF stripline structures could in principle be constructed from conductive areas on the feed layers and conveniently accommodated in the region between the enclosure and the cover.

The above embodiments are to be understood as illustrative examples of the invention and other embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An antenna structure, comprising:

an electrically conductive enclosure of the antenna, the electrically conductive enclosure comprising:

an electrically conductive enclosure with an aperture formed in an end thereof; and wherein a size of the aperture is defined by a first distance between two sides of the aperture;

an electrically conductive cover comprising:

a first portion that covers at least part of the aperture, the first portion comprising a slot in association with the aperture, wherein a size of the slot is defined by a second distance between two sides of the slot, wherein the first distance is greater than the second distance; and a second portion that covers at least part of a first side wall of the electrically conductive enclosure;

a feed layer located between the electrically conductive enclosure and the first portion of the electrically conductive cover, the feed layer being arranged to carry electrically conductive track, wherein a radiating portion of the electrically conductive track is configured to be in registration with the slot;

at least one dielectric material between the electrically conductive enclosure and the electrically conductive cover;

wherein the end wall of the electrically conductive enclosure defines a plane of the aperture, and wherein the side walls of the electrically conductive enclosure comprises a fencing portion, and the fencing portion extends beyond the plane of the aperture so as to form a gap between the fencing portion and an internal face of the cover, wherein the gap is configured to improve isolation provided by the fencing structure.

2. The antenna structure of claim 1, wherein the electrically conductive enclosure further comprises a second side wall, and wherein the distance between the sides of the slot extends from the first wall and to the second side walls of the electrically conductive enclosure.

3. The antenna structure of claim 1, wherein at least one dielectric material is located between the electrically conductive cover and the feed layer, or between the electrically conductive enclosure and the feed layer.

4. The antenna structure of claim 1, wherein spacers are located between the electrically conductive cover and the feed layer, or between the electrically conductive enclosure and the feed layer.

5. The antenna structure of claim 1, wherein the fencing portion extends beyond the plane of the aperture by an amount less than the distance between the plane of the aperture and the first portion of the electrically conductive cover.

6. The antenna structure of claim 1, wherein part of the electrically conductive enclosure comprises at least one dielectric material.

7. The antenna structure of claim 1, wherein part of the electrically conductive enclosure comprises at least one dielectric material, and wherein at least one dielectric material is placed on part of an external face of the first portion of the electrically conductive cover.

8. The antenna structure of claim 1, wherein part of the electrically conductive enclosure comprises at least one dielectric material, and wherein the dielectric material covers the slot.

9. The antenna structure of claim 1, wherein the first portion of the electrically conductive cover protrudes beyond a side wall of the enclosure so that a ground plane formed by the surface of the cover surrounding the slot is extended.

10. The antenna of claim 1, wherein the dielectric material comprises foam.

11. An antenna array, comprising:

an electrically conductive enclosure of the antenna array, comprising:

at least one internal wall between at least two cavities within the enclosure; and a plurality of apertures in an end of the electrically conductive enclosure, wherein at least one of the apertures is in association with at least one of the cavities, wherein a size of at least one of the apertures is defined by a distance between two sides of the aperture;

an electrically conductive cover, comprising:

a first portion that covers at least one of the apertures, the first portion comprising a plurality of slots, wherein at least one slot is in association with at least one of the cavities, wherein a size of the slot is defined as a distance between two sides of the slot, and wherein the size of the aperture is greater than the size of the slot; and a second portion that covers at least part of a side of the electrically conductive enclosure;

a first feed layer located between the electrically conductive enclosure and the first portion of the electrically conductive cover, the first feed layer arranged to carry electrically conductive track, wherein at least one radiating portion of the electrically conductive track is configured to be in registration with at least one slot in association with at least one of the apertures;

at least one dielectric material between the electrically conductive enclosure and the electrically conductive cover;

wherein the end of the electrically conductive enclosure defines a plane of the aperture, and wherein the side of internal wall of the electrically conductive enclosure comprises a fencing portion, and the fencing portion extends beyond the plane of at least one aperture so as to form a gap between the fencing portion and an internal face of the cover, wherein the gap is configured to improve isolation provided by the fencing structure.

12. The antenna array of claim 11, wherein the distance of at least one of the apertures formed in the end of the electrically conductive enclosure is from one of the side walls to at least one internal wall of the electrically conductive enclosure.

13. The antenna array of claim 11, wherein at least one dielectric material is located between the electrically conductive cover and the feed layer, or between the electrically conductive enclosure and the feed layer.

14. The antenna array of claim 11, wherein spacers are located between the electrically conductive cover and the feed layer, or between the electrically conductive enclosure am the feed layer.

15. The antenna array of claim 11, wherein the fencing portion extends beyond the plane of the aperture by an amount less than the distance between the plane of the apertures and the first portion of the cover.

16. The antenna array of claim 11, wherein part of the electrically conductive enclosure contains at least one dielectric material.

17. The antenna array of claim 11, wherein substantially all of the electrically conductive enclosure contains at least one dielectric material.

18. The antenna array of claim 11, wherein part of the electrically conductive enclosure contains at least one dielectric material, and wherein the dielectric material is placed on part of an external face of the first portion of the cover.

19. The antenna array of claim 11, wherein part of the electrically conductive enclosure contains at least one dielectric material, and wherein the dielectric material covers at least one slot.

20. The antenna array of claim 11, wherein the first portion of the electrically conductive cover protrudes beyond a side wall of the electrically conductive enclosure so that a ground plane formed by the surface of the cover surrounding the slot is extended.

21. The antenna array of claim 11, wherein the first feed layer is arranged to partially extend between the electrically conductive enclosure and the second portion of the electrically conductive cover.

22. The antenna array of claim 21, wherein a second feed layer is placed between the electrically conductive enclosure and the electrically conductive cover.

* * * * *

UNITED STATES PATENT AND TRADEMARK OFFICE

CERTIFICATE OF CORRECTION

PATENT NO. : 8,514,139 B2
APPLICATION NO. : 11/966501
DATED : August 20, 2013
INVENTOR(S) : David Adams et al.

It is certified that error appears in the above-identified patent and that said Letters Patent is hereby corrected as shown below:

In the Claims:

Claim 11, Column 12, Line 45, please delete “the end” and substitute -- the end wall --

Claim 11, Column 12, Line 46, please delete “of internal wall” and substitute -- walls --

Claim 11, Column 12, Line 49, please delete “at least one” and substitute -- the --

Claim 14, Column 12, Line 65, please delete “am” and substitute -- and --

Signed and Sealed this
Third Day of June, 2014

Michelle K. Lee

Michelle K. Lee
*Deputy Director of the United States Patent and Trademark Office*